United States Patent [19]

Schoeck

[11] Patent Number: 4,793,062

[45] Date of Patent: Dec. 27, 1988

[54] DEVICE FOR REMOVING PLASTER FROM WALLS

[76] Inventor: Wolfgang Schoeck, Bismarckstrasse 11, D-7417 Pfullingen, Fed. Rep. of Germany

[21] Appl. No.: 921,774

[22] Filed: Oct. 21, 1986

[30] Foreign Application Priority Data

Oct. 21, 1985 [DE] Fed. Rep. of Germany ..... 3537372

[51] Int. Cl.[4] ..... B26B 3/00

[52] U.S. Cl. ..... 30/172; 15/236.01

[58] Field of Search ..... 30/169–172; 15/93 R, 93 C, 236 R

[56] References Cited

U.S. PATENT DOCUMENTS 2,853,820 9/1958 Barker ..... 30/169

2,984,908 5/1961 Dyer ..... 30/172 X

FOREIGN PATENT DOCUMENTS 2453262 2/1978 Fed. Rep. of Germany .

*Primary Examiner*—Douglas D. Watts

*Attorney, Agent, or Firm*—Michael J. Striker

[57] ABSTRACT

A hand-held device for removing plaster from walls includes a housing provided with a single handgrip and two tool-supports oscillatorily movable in counter directions by two pneumatically or hydraulically actuated cylinder-piston units and carrying shaving tools. A pressure medium source and a control equipment for the cylinder-piston units is positioned outside of the device and remote from the same.

11 Claims, 2 Drawing Sheets

DEVICE FOR REMOVING PLASTER FROM WALLS

BACKGROUND OF THE INVENTION

The present invention relates to a device for removing plaster from a wall.

Devices for the removal of plaster from walls of the foregoing type include a housing having a hand grip and a supporting and a closing plates, and two oscillatory tool supports movable in opposite directions and positioned in the housing and supporting cutting tools for removing plaster from walls.

Devices of the type under consideration serve to flatten and/or shape the upper surface of the freshly plastered wall hours before the plaster is completely dried-up and hardened. This after-treatment of the plastered walls is particularly required when the plaster is mechanically sprayed onto the wall.

Devices for the mechanical removal of plaster from walls have been known. Such a device has been disclosed, for example in DE-PS No. 2453262. All known mechanical devices for removing plaster from the wall have, however the disadvantage which resides in that the manupulation of such devices is quite troublesome because in many cases the plaster sticks the hand scraper, and a considerable muscle effort is necessary to use the gripping board having the steel rods when the planing of the plaster layers is required. In the device disclosed in DE-PS No. 2453262 also the operation is difficult due to the use of the electric motor with the transmission connected thereto because the whole device must be held with two hands gripped on the two handgrips. Inasmuch as circular movements on the plastered surface must be performed an operator has to hold heavy weights with both hands. The operator must also work on a scaffold platform whereby working with two hands holding the heavy device becomes dangerous.

It has been also known that with hand-held mechanically operated devices for removing plaster from walls, for example cutting knives or hedge clippers, these devices must be provided with counter parts for compensating for occuring torques and for the compensation for force impulses appearing on the hand of the operator. These means can not, however, prevent substantial vibrations which result from the heavy weight of the device and thus prevent the fatigue and possible danger to the operator with the devices in which the operator must carry also the drive motor and the crank transmission or the like, by means of which a rotational movement of the motor is translated into the oscillating reciprocating motions.

SUMMARY OF THE INVENTION

It is an object of the present invention to provide an improved device for the removal of plaster from walls.

It is another object of the invention to provide a device of the foregoing type, which is light so that a user would be able to hold and use it with one hand.

These and other objects of the invention are attained by a device for removing plaster from a wall, comprising a housing having a carrying plate; two tool supports positioned in said housing and oscillatorily movable in a straight-line motion in counter directions relative to each other, said tool supports each carrying a cutting tool; at least two cylinder-piston units, each cylinder-piston unit being coupled with a respective tool support and acting as a drive organ, said housing having a central plane extending normal to the direction of movement of said tool supports, said tool supports being positioned symmetrically relative to said central plane; and a single handgrip being centrally positioned on an upper side of said cover plate.

In the device according to the invention, pneumatic or hydraulic cylinder-piston units can be utilized as well as a pneumatic or hydralic pressure medium source or generator. Such a device would also require conventional valves but all these structural components would be located remotely from the device so that the operator would not have to hold them.

The weight of the device of the invention is substantially reduced as compared to conventional devices of the type under discussion. The device according to the invention is very compact and comparable in size with hand-held pluster scrapers.

According to a further feature of the invention each cylinder-piston unit may include a cylinder housing connected to said cover plate and having a cylinder with a double-acting piston having a piston rod and at least one holding element connected to a free end of said piston rod, each tool support being plate-shaped and connected to said holding element.

The device may further include guiding rods each supported in said cylinder housing of each unit and connecting two holding elements positioned at opposite sides of the cylinder housing of each unit to each other.

Each cylinder housing is a housing block in which a cylinder with a piston loadable at two sides is positioned. Two parallel cylinders with one-side loadable pistons can be also employed.

The piston-cylinder units ensure a compact and space-saving device which is also very light.

Each tool support may be provided with a releasable and interchangeable shaving tool having cutting blades for both directions of movement.

The shaving tools of the two tool supports may have equally-sized working surfaces.

The drive of the device of this invention ensures the formation of the movable masses of the same size and also an exact ajustment of the movement paths of the two drive organs. Vibrations transmitted to the handgrip held by the operator are minimal and practically the operation of the device limits various resistance values which act on the single tool from the wall being treated and are quite considerable with hand plaster scrapers.

The housing can be practically limited to one carrying plate, on the one side of which the handgrip would be arranged and the other side of which can carry the cylinder-piston units. The bearing locations of the piston rods and guiding rods must be well-sealed so that a reliable operation of the drive organs in the dusty environment is ensured.

The tool supports may have extensions which in each operational position overlap each other and which form protecting walls for protecting an interior of said housing against dust.

The frequency of oscillatory movements of said tool supports may be adjustable, whereby the adjustment of the pneumatic or hydraulic control devices can be stepless. Thus the operation rhythm of the device can lie in or be adjusted to the resonance-free frequency region.

Each tool support may be plate-shaped, said housing being U-shaped, each plate shaped-support being supported in said housing and having a mounting web, said housing having a covering wall formed with a slot which is sealed and receives said mounting web, said web extending outwardly from said housing and carrying said cutting tool.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
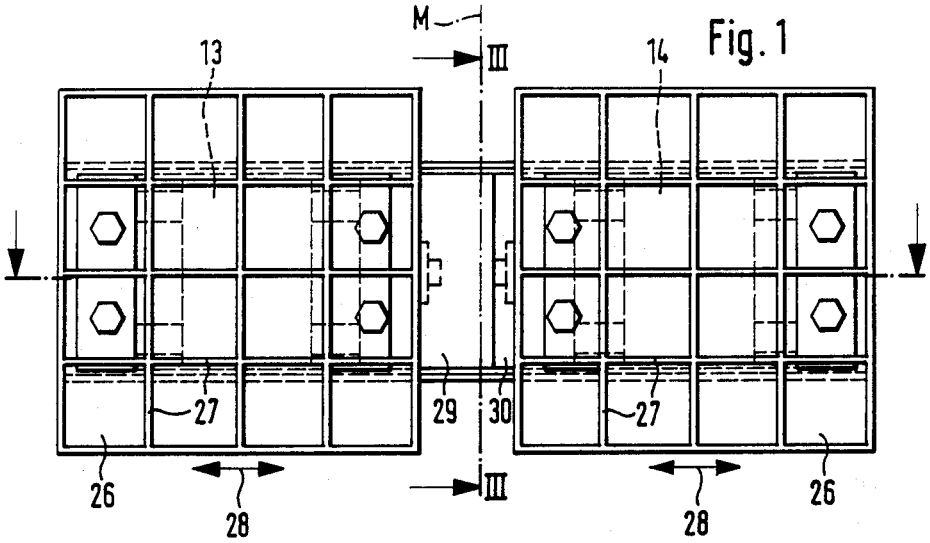
FIG. 1 is an underside view of the device for removing plaster from walls, showing the working surfaces of the plaster removing tools.

The device for removing plaster from walls of the invention comprises a trough-shaped housing 10 the central part of which forms a carrying plate 11 to the upper side of which and centrally of the housing 10 a hand grip 12 is secured. On the underside of the plate 11 are provided cylinders 13 and 14 of two cylinder-piston units. Cylinders 13 and 14 are positioned in the interior of the housing 10 and are spaced from each other and arranged symmetrically relative to a central plane M which corresponds to section line III-III so that piston rods 15 and 16 extending from the cylinder elements 13, 14, respectively and projected in the direction of elongation of housing 10 are in alignment with each other. The two cylinder-piston units are identical to each other and positioned mirror-inverted with each other. In the cylinder elements 13 and 14 of both cylinder-piston units, are formed bores for receiving guiding rods 17 and 18 which are parallel to piston rods 15 and 16.

To each end of the guiding rod 17 and 18 is connected a square-shaped holding element 19, 20 and 21, 22, respectively. These holding elements respectively connect the guiding rods 17 and 18 to each other. At each inner holding element 20, 21 of each cylinder-piston unit is secured the free end of the respective piston rod 15 or 16. The freely positioned parts of the piston rods 15, 16 and the guiding rods 17, 18 can be enclosed in non-shown protective bellows.

Figure 3:
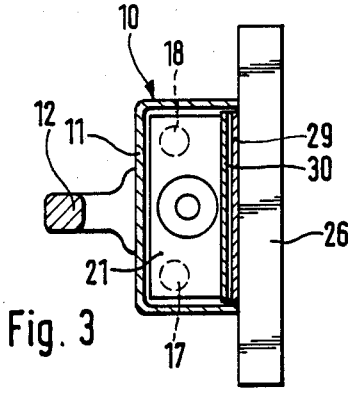
FIG. 3 is a sectional view taken along line III—III of FIG. 1.

Two plate-shaped tool supports 23 and 24 are secured to the undersides of the holding elements 19, 20 and 21, 22 of both cylinder-piston units. These tool supports are connected to the respective holding elements by bolts 25. An interchangeable grate-shaped shaving tool 26 is fastened to each tool support 23 and 24. These shaving tools are laterally protruding from the housing 10 as seen from FIG. 3. Each shaving tool has at the working surface thereof webs 27 extending in the longitudinal and transversal direction of the housing and crossing each other as shown in FIG. 1. The edges of the webs 27 form shaving blades of the tools. Some of these edges are operative in one direction of movement of the tool and the other edges are operative in the opposite direction of movement of the tool. It is understandable that any other suitable structure of the shaving tools can be employed in the device of this invention.

Both cylinder-piston units, namely their cylinder elements 13 and 14 are connected in the conventional manner with a pressure air source and a control device connected thereto so that an oscillating movement in the directions of double arrow 28 is imparted to the double-acting pistons with their piston rods 15 and 16. Thereby the control device (non shown and conventional) is adjusted so that oscillating motions of the aligned cylinder-piston units, transmitted to the tool supports 23 and 24 with the respective shaving tools 26, are always directed opposite to each other. Both tool supports 23 and 24 have at the middle region of the housing, extensions 29 and 30 which overlap each other and make penetration of dust into the housing interior 31 more difficult. The shaving tools 26 can be secured directly to the holding elements 19, 20 while parts 23 and 24 can be omitted or can form cover walls only.

The non-illustrated control device for pneumatic cylinder-piston units is constructed in the known fashion so that the oscillating frequency of both units is synchronous and is adjustable to be of the same magnitude.

The device according to the invention is operated by a single person who holds it by hand at the grip 12. The operating grip 12 can be provided with a switch (non-shown) by means of which the cylinder elements 13, 14 of both cylinder-piston units can be simultaneously switched on. The pressure air connection, switching valves and control valves of the control device as well as the pressure air source or generator are all well known and therefore not described herein. All these structural components with a possible exception of the switch are positioned in the unit remote from the housing 10.

Figure 2:
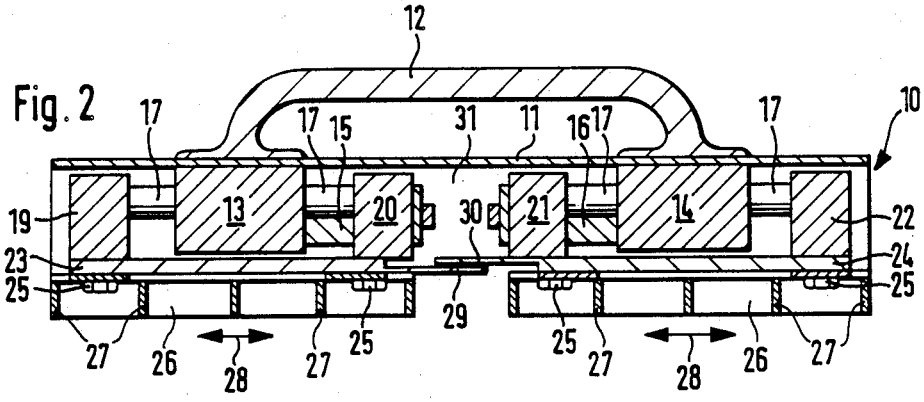
FIG. 2 is a sectional view taken along line II—II of FIG. 1.
Figure 4:
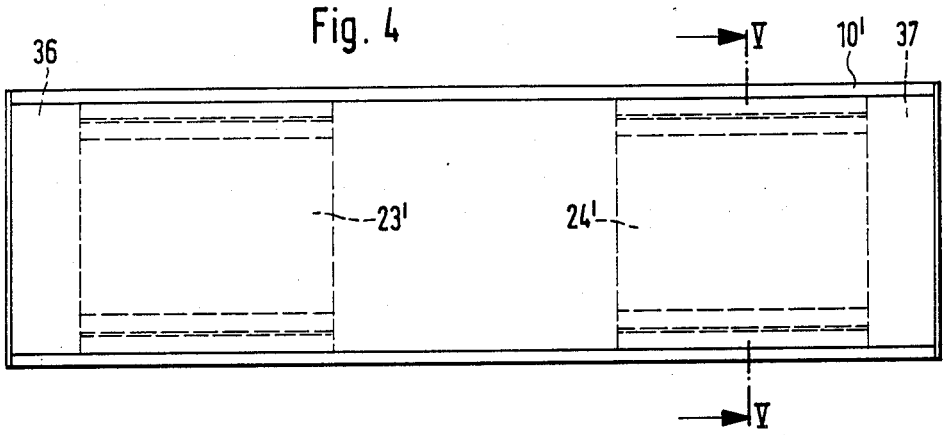
FIG. 4 is a top plan view of the gripping side of the housing of the device according to a second embodiment.
Figure 5:
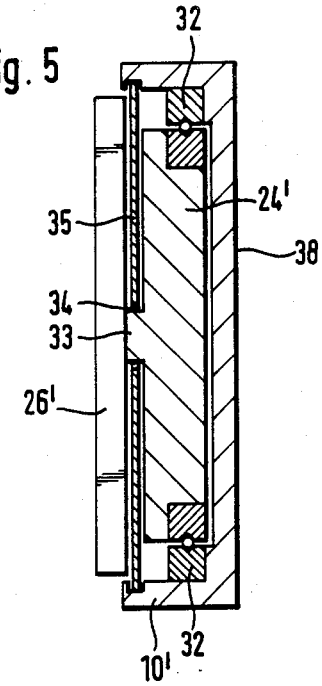
FIG. 5 is a sectional view taken along line V—V of FIG. 4, on enlarged scale.

In the embodiment illustrated in FIGS. 4 and 5, both tool supports 23' and 24' are positioned in the interior of the U-shaped housing 10' and are supported therein in roller bearings 32. As can be seen from FIG. 5 each tool support has a web 33 by means of which each tool support extends in a slot 34 provided in a housing wall 35 and sealed at both ends. Housing wall 35 closes the housing 10' at the working side of the tool of this invention. An interchangeable shaving tool 26 is mounted on the mounting web of each tool support. Each tool support is provided with the assigned cylinder-piston unit simularly to the embodiment of FIGS. 1–3. These units can be, for example arranged in housing end regions 36 and 37. The cylinder of each cylinder-piston unit can be also formed in the body of the respective tool support 23', 24'. The cylinder-piston units can be also positioned in the end regions of the housing on the upper gripping side 38 of the U-shaped housing 10; they can be also mounted in the extension of the centrally arranged hand grip non-shown in FIGS. 4 and 5 and coupled to the tool supports 23' and 24' supported in the ball bearings at a slot in the housing.

The modification shown in FIGS. 4 and 5 provides for a very flat structure with good protection of the drive organs by means of the housing cover wall 35.

It will be understood that each of the elements described above, or two or more together, may also find a useful application in other types of devices for the removal of plaster from walls differing from the types described above.

While the invention has been illustrated and described as embodied in a device for removing plaster from walls, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for removing plaster from a wall, comprising a housing including a carrying plate; a single handgrip secured to said carrying plate; two tool supports positioned in said housing and oscillatorily movable in a straight-line motion in counter directions relative to each other, said tool supports each carrying a cutting tool; at least two cylinder-piston units positioned in said housing, each cylinder-piston unit being coupled with a respective tool support and acting as a drive organ therefor, said housing having a central plane extending normal to the direction of movement of said tool supports, said tool supports being positioned symmetrically relative to said central plane; said handgrip being centrally positioned on an outer side of said carrying plate.

2. The device as defined in claim 1, wherein said single handgrip extends in the direction of movement of said tool supports.

3. The device as defined in claim 1, wherein each cylinder-piston unit includes a cylinder housing connected to said carrying plate and having a cylinder with a double-acting piston having a piston rod, and at least one holding element connected to a free end of said piston rod, each tool support being plate-shaped and connected to said holding element.

4. The device as defined in claim 3, further including guiding rods each supported in said cylinder housing of each unit and connecting two holding elements positioned at opposite sides of the cylinder housing of each unit to each other.

5. The device as defined in claim 4, wherein each tool support is provided with a releasable and interchangeable shaving tool having cutting blades for both directions of movement.

6. The device as defined in claim 5, said shaving tools of two tool supports having equally-sized working surfaces.

7. The device as defined in claim 6, wherein said working surfaces are square-shaped.

8. The device as defined in claim 5, wherein said tool supports have extensions which in each operational position overlap each other and which form protecting walls for protecting an interior of said housing against dust.

9. The device as defined in claim 1, wherein a frequency of oscillatory movements of said tool supports is adjustable.

10. The device as defined in claim 1, wherein said tool supports are displaceably supported by ball bearings in said housing in the direction of elongation thereof.

11. The device as defined in claim 10, wherein each tool support is plate-shaped, said housing being U-shaped, each plate-shaped support being supported in said housing and having a mounting web, said housing having a covering wall formed with a slot which is sealed and receives said mounting web, said web extending outwardly from said housing and carrying said cutting tool.

* * * * *